US005860898A

United States Patent [19]

Ellis

[11] Patent Number: 5,860,898

[45] Date of Patent: Jan. 19, 1999

[54] EXERCISE APPARATUS

[76] Inventor: Eric E. Ellis, 39-06 114th St., Corona, N.Y. 11368

[21] Appl. No.: 991,509

[22] Filed: Dec. 16, 1997

[51] Int. Cl.[6] ..... A63B 21/02

[52] U.S. Cl. ..... 482/130; 482/79; 482/71

[58] Field of Search ..... 482/130, 79, 80, 482/70, 71, 121, 123

[56] References Cited

U.S. PATENT DOCUMENTS 1,750,549 3/1930 Thomson et al. ..... 482/130

3,770,267 11/1973 McCarthy ..... 482/130

5,279,530 1/1994 Hess ..... 482/79

5,496,246 3/1996 Pierre ..... 482/130

*Primary Examiner*—Lynne A. Reichard

*Attorney, Agent, or Firm*—Goldstein & Canino

[57] ABSTRACT

An exercise apparatus of the type for exercising the muscles of a user by providing spring or elastic loaded resistance to repetitive movements of a user having a horizontally extending frame assembly. The exercise apparatus includes biased foot pedals and elastic cables that are user operable to exercise a variety of muscles or muscle groups of a user. An adjustable seat having a back that may be folded for storage is also included.

10 Claims, 2 Drawing Sheets

EXERCISE APPARATUS

BACKGROUND OF THE INVENTION

1. Field of the Invention

The invention relates generally to exercise equipment. More particularly, the present invention relates to a compact, simple and flexible full body exercise apparatus.

2. Background and Objects of the Invention

There are many types of exercise equipment known in the art. One class of exercise equipment available is intended to work specific muscle groups. For example stationary bicycles, treadmills, and stepper machines, are generally employed to work the leg and buttock muscles. Often these devices are large and not easy to store. Further, if a full body workout is desired, wherein most or all muscle groups are exercised, other apparatus must be employed.

There are also known in the art many complex exercisers. These are often configurable or adjustable to enable a user to do many varied and different exercises, typically in a number of positions (i.e., sitting, laying down, standing, etc.). For example U.S. Pat. No. 4,821,152 to Wolff, is one such apparatus. These systems are mechanically complicated, having many parts, and may require the user to rearrange or add constituent portions, to accommodate the various exercises supported. These types of exercisers are also expensive, and typically do not fold to enable a user to store them in a small area, for example, under a bed.

Objects of the present invention are, therefore, to provide a new and improved exercise apparatus having one or more of the following capabilities, features, advantages, and/or characteristics:

- a modular simple device;
- enables a user to exercise many of the muscles or muscle groups of the user's body;
- low cost construction using many readily available components and or materials;
- storable in a relatively small area;
- quickly adjustable to accommodate users of differing heights.

The above listed objects, advantages, and associated novel features of the present invention, as well as others, will become more clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the invention, an exercise apparatus of the type for exercising particular muscles or muscle groups of a user is disclosed, wherein muscles are exercised by providing resistance to repetitive movements of the user. A horizontally extending frame assembly is provided having at least two biasing elements, which may be provided by helical springs or other known elastic means. Each biasing element has a first end and a second end, with the first end adjustably fixed to the frame assembly. A plurality of foot pedals are included that are slidably mounted on the frame assembly. The foot pedals are moveable between a first position, proximate to the user, and a second distal position. The second end of each biasing element is coupled to each foot pedal for biasing the foot pedals in the first position and providing resistance when the user applies a suitable force to move a respective foot pedal to the second position. A seat is provided that is adjustably mounted to the frame assembly. The position of the seat may be altered to enable the distance between the seat and foot pedals to be adjusted to a user desired distance.

The exercise apparatus further includes a plurality of elastic cables, each having a first end and a second end. The first end of the elastic cables is removably anchored to the frame assembly, with the second end configured for grasping by the user. In a preferred embodiment, a suitable means may be provided for anchoring the first end of each of the elastic cables to the frame assembly in one of a plurality of available and preconfigured positions. The foot pedals and elastic cables are each configured to enable the user to exercise particular muscles or muscle groups, as desired.

BRIEF DESCRIPTION OF THE DRAWINGS

In the drawings, like elements are depicted by like reference numerals. The drawings are not necessarily to scale, with the emphasis instead placed upon the principles of the present invention. The drawings are briefly described as follows.

LIST OF REFERENCE NUMERALS USED IN THE DRAWINGS

10—exercise apparatus
12—frame assembly
16—slotted members
16*a*—slots
18—cross members
18*a*—thru holes
20—foot pedals
20*a*—first position (biased, proximal position)
20*b*—second position (distal position)
22—seat
22*a*—seat back
24—seat support member
24*a*—locking pin
28—adjustment knob
30—cross supports
32—biasing element
32*a*—first end (of biasing element)
32*b*—second end (of biasing element)
32—biasing element
36—elastic cable
36*a*—first end (of elastic cable)
36*b*—second end (of elastic cable)
38—handle
40—linear rod assembly
42—threaded rod
42*a*—front end (of the threaded rod)
42*b*—back end (of the threaded rod)
42*c*—threaded portion (of the threaded rod)
42*d*—unthreaded portion (of the threaded rod)
44—first end block

46—second end block
50—slider
52—threaded block
56—rod
58—linear roller bearing

DETAILED DESCRIPTION OF THE PREFERRED EMBODIMENTS

Figure 1:
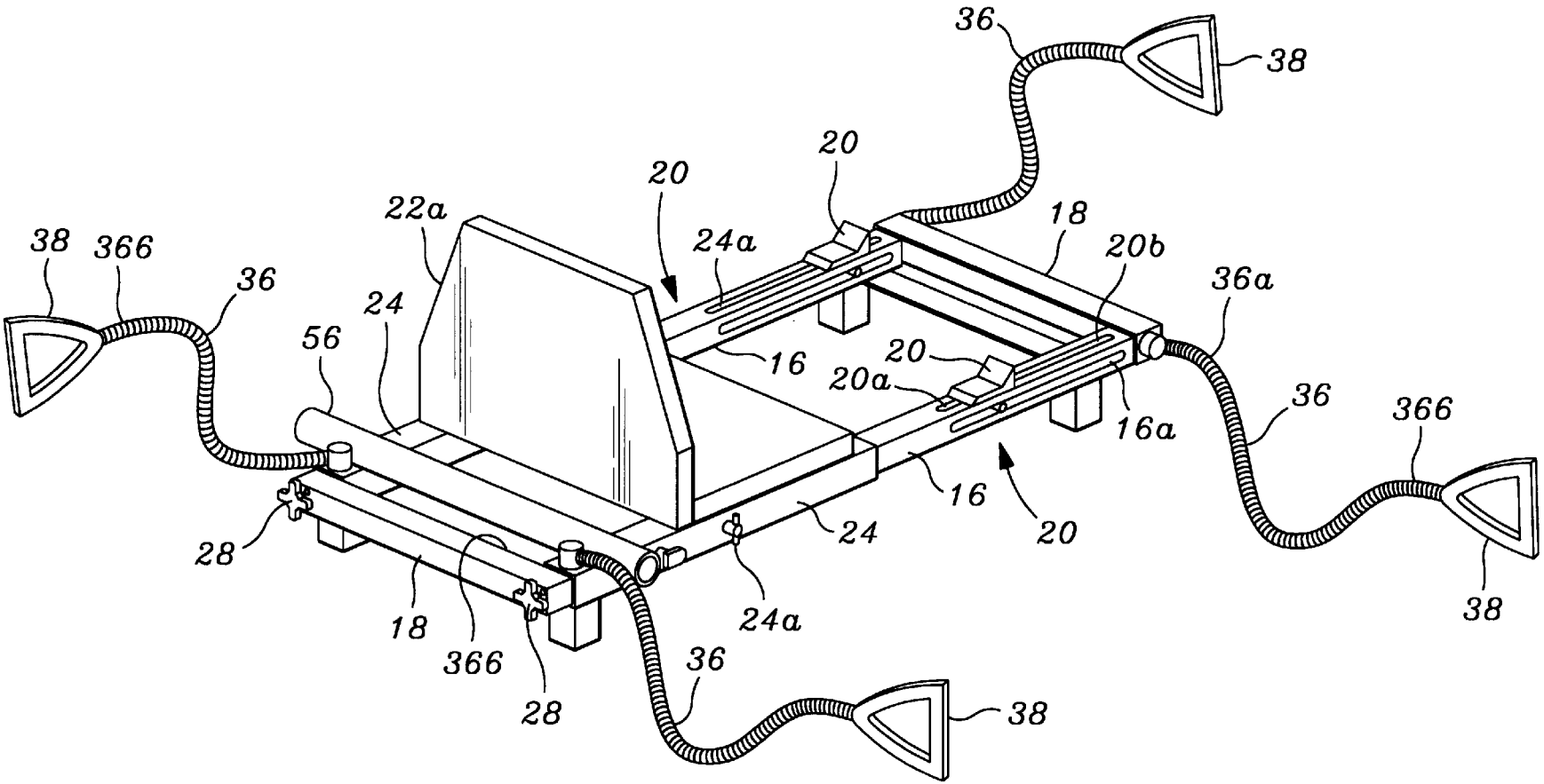
FIG. 1 provides a perspective view of the exercise apparatus of the present invention.
Figure 4:
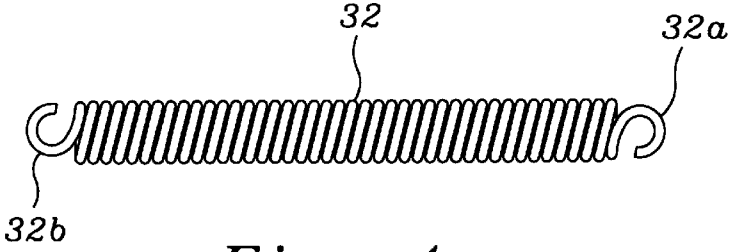
FIG. 4 depicts a biasing element in the form of a helical biasing spring that may be employed with the linear rod assembly.
Figure 3:
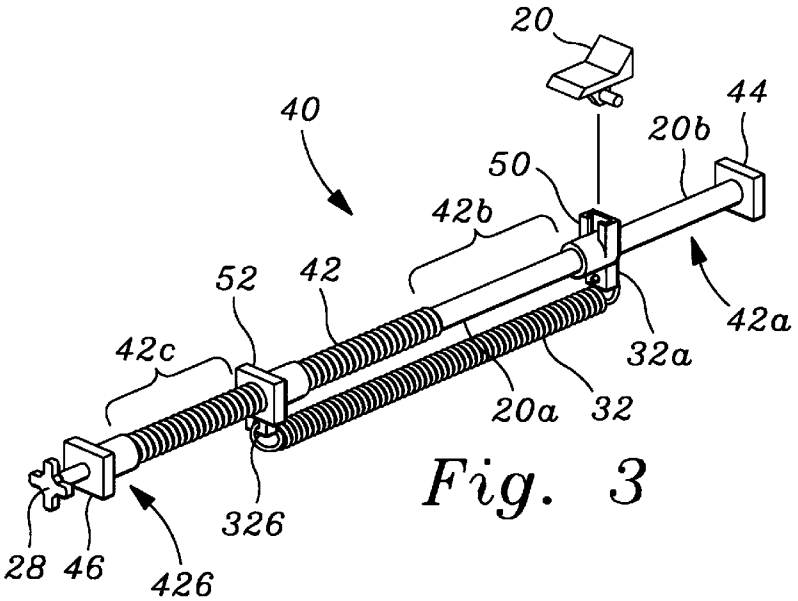
FIG. 3 illustrates a linear rod assembly employed with the exercise apparatus.

Referring now to FIG. 1, there is provided a perspective view of the exercise apparatus 10 of the present invention. A frame assembly 12 is comprises a pair of spaced and elongated slotted members 16 and a pair of cross members 18. As illustrated in FIG. 1, the slotted members 16 and cross members 18 are connected to establish a substantially rectangular shape to the frame assembly 10. The slots 16*a* in each of the slotted members 16 are provided to enable foot pedals 20 that are included with the exercise apparatus 10 to be slidably mounted to the frame assembly. The foot pedals 20 are slideable to be movable between a first position 20*a* and a second position 20*b*. The first position 20*a* may be termed 'proximal' to the user, while the second position 20*b* may be termed 'distal' to the user (or the position/location of the user). The foot pedals 20 are each biased in the first position 20*a* by a biasing element 32. As best seen in FIGS. 3 and 4, the biasing element 32 is depicted as a spring, but may be provided by other suitable means having a desired elasticity. The biasing elements 32 may also be termed an elastic means. A seat 22 is adjustably mounted on the frame assembly 10 to enable the position of the seat to be adjusted to in a 'forward and back' manner. Accordingly, the position of the seat may be adjusted to accommodate user's of differing heights. In particular, if a user has long legs the seat may be moved back, thereby increasing the distance between the foot pedals 20 and the seat 22. Means may be provided, such as in the form of a spring loaded locking pin 24*a*, to secure the seat in the final desired position. Alternately, a clamping or friction based device may be employed to lock the seat in a selected position. A plurality of seat support members 24 may be included to slide on the slotted members 16 to facilitate the adjustment of the seat 22.

As can be seen in FIG. 1, a plurality of elastic cables 36 are included with the exercise apparatus 10, each having a first end 36*a* and a second end 36*b*. The first end 36*a* of the elastic cables 36 may be removably anchored or mounted to the frame assembly 12 to enable the user to select a particular location during an exercise session. The particular means utilized to anchor the first end 36*a* to the frame assembly 20 may simply be a wing nut and stud (not shown) or other known 'quick connect' mechanisms available in the art. The position where the elastic cables 36 are anchored is contemplated to be at or near the corners of the frame assembly 12 (as shown). Each elastic cable 36 may be configured with a handle 38, fixed to the second end 36*b* of the elastic cable.

Figure 2:
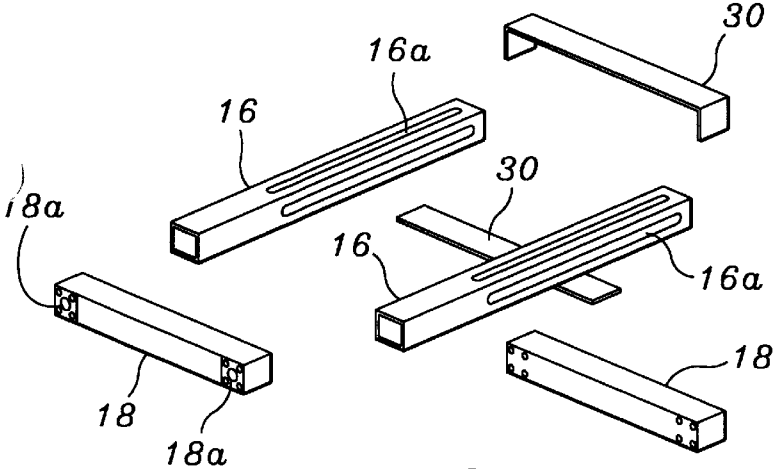
FIG. 2 is an exploded view of a portion of a frame assembly included with the invention.

Turning to FIG. 2, there is illustrated an exploded view of a portion of the frame assembly 12. Clearly shown are the spaced elongated slotted members 16 and the cross members 18. One of the cross members may be configured with thru holes 18*a*, to accommodate the adjustment knobs 28. One or more cross supports 30 may be included (as seen in FIGS. 1 and 2) to stiffen the frame assembly 12, as required. It must be understood that the frame assembly 12 may be provided by other structures as can be provided by skilled persons. For example, each cross member 18 and each slotted member 16 may be comprised of a plurality of elements or components (not explicitly shown for simplicity).

Referring now to FIG. 3, there is illustrated a linear rod assembly 40 employed with the exercise apparatus 10. A threaded rod 42 is provided having a to a front end 40*a* and a back end 40*b*. The threaded rod 42 includes threaded portions 42*d*, and may include un-threaded portions 42*c*. A first end block 44 is rotatably mounted at the front end 40*a*, while a second end block 46 is rotatably mounted at the back end 40*b*. The first end block 44 and the second end block 46 are each provided to rotatably support the threaded rod 42 within the frame assembly 12.

As skilled individuals will appreciate, a bearing means (not shown) may be employed to rotatably mount the first end block and the second end block to the threaded rod 42 to reduce the friction encountered by a user when rotating the threaded rod. A threaded block 52 is adjustably mounted on the threaded rod 42 so as to enable the (linear) position of the threaded block 52 to be altered or adjusted with respect to the front end 40*a* and the back end 40*b*. The treaded block is arranged to receive and secure the first end 32*a* of a respective biasing element 32. The position of the threaded block 52 on the threaded rod 42 is alterable by the user by rotating the threaded rod 42 via the adjustment knob 28. A slider 50 is also included and slidably disposed upon the threaded rod 42, possibly on the unthreaded portion thereof. The slider 50 is movable between a first position 20*a* and a second position 20*b*. The slider 50 is configured to accept and securely hold a respective foot pedal 20. Note that the first position 20*a* of the slider 50 corresponds to the first position of the foot pedal, and the second position 20*b* of the slider 50 corresponds to the second position of the foot pedal 20.

As can be seen in FIG. 3, the second end 32*b* of the biasing element 32 is secured to the slider 50. Therefore, the second end 32*b* is coupled to the foot pedal 28. Accordingly, by rotating the threaded rod 42 (via the adjustment knob 28), the distance between the threaded block and the slider may be altered by the user to adjust the tension or biasing force applied to a foot pedal 20 by the biasing element 32.

It is important to note that the adjusting knobs 28 may be arranged to be provided at the front ends 42*a* of the linear rod assembly 40 instead of the back end. Further, it is contemplated that adjustment knobs may be provided at both the front end and the read end of each linear rod assembly 40.

Figure 5:
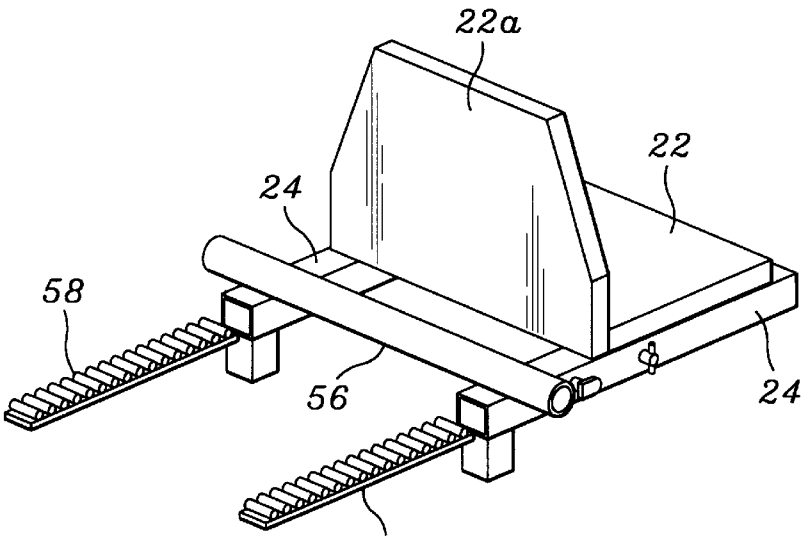
FIG. 5 is a perspective view of an embodiment of a seat arrangement employed with the invention.

Referring now to FIG. 5, a rod 56 can be seen that may be mounted on the seat support members 24, which may be grasped by the user to aid the balance of the user when using the exercise apparatus 10. The rod 56 would be arranged to have a length that is greater than the width of the seat 22. Also shown in FIG. 5 are linear roller bearings 58, that may be included to reduce the friction encountered by the user when adjusting the position of the seat 22.

It is important to understand that the above description of the exercise apparatus 10 of the present invention is exemplary only, and other equivalent arrangements may be provided. Therefore, while there have been described the currently preferred embodiments of the present invention, those skilled in the art will recognize that other and further modifications may be made without departing from the present invention, and it is intended to claim all modifications and variations as fall within the scope of the invention.

What is claimed is:

1. An exercise apparatus of the type for exercising the muscles of a user by providing resistance to repetitive movements of the user, the apparatus comprising:

(a) a horizontally extending frame assembly;

(b) a plurality of biasing elements, each having a first end and a second end, the first end adjustably fixed to the frame assembly;

(c) a plurality of foot pedals slidably mounted on the frame assembly, the foot pedals moveable between a first position proximate to the user and a second distal position when the user applies a suitable force, the second end of each biasing element connected to each foot pedal for biasing the foot pedals in the first position and providing resistance when moving the foot pedals to the second position;

(d) a seat adjustably mounted to the frame assembly, the position of the seat being alterable to enable the distance between the seat and foot pedals to be adjusted to a user desired distance;

(e) a plurality of elastic cables, each having a first end and a second end, the first end removably anchored to the frame assembly and the second end configured for grasping by the user; and (f) means for anchoring the first end of each of the elastic cables to the frame assembly in one of a plurality of available and preconfigured positions;

(g) the foot pedals and elastic cables each configured to enable the user to exercise particular muscles or muscle groups.

2. The exercise apparatus according to claim 1, wherein the frame assembly includes two spaced and parallel linear rod assemblies, each linear rod assembly comprising:

(a) a partially threaded rod having a front end and a back end with the threading located proximal to one of the front end and the back end;

(b) a first end block rotatably mounted to the front end of the threaded rod;

(c) a second end block rotatably mounted to the back end of the threaded rod, the first end block and the second end block arranged to support the threaded rod within the frame assembly;

(d) a threaded block that is adjustably mounted on the threaded portion of the threaded rod and arranged to receive the first end of a respective biasing element, wherein the position of the threaded block on the threaded rod is alterable by the user to enable the adjustment of a biasing force provided by the biasing elements upon a respective foot pedal; and (e) a slider, which is slideably mounted on the threaded rod, the slider configured to accept and securely hold a respective foot pedal.

3. The exercise apparatus according to claim 2, wherein the first end block and the second end block are each rotatably mounted to the threaded rod by means including bearing means.

4. The exercise apparatus according to claim 3, wherein at least one of the front end block and the back end block is configured with an adjustment knob coupled to the threaded rod to enable a user to readily rotate the threaded rod and alter the position of the threaded block to adjust the biasing force.

5. The exercise apparatus according to claim 4, wherein the slider is mounted and positioned upon a portion of the threaded rod that is not threaded.

6. The exercise apparatus according to claim 1, further including a linear roller bearing that is provided between the seat and the frame assembly to enhance the adjustability of the seat.

7. The exercise apparatus according to claim 1, wherein each elastic cable includes;

(a) an elastic portion to provide resistance to movements by the user when stretching the elastic cable; and (b) a handle fixed to the elastic portion and arranged for enabling a user to securely grasp the second end of the elastic cable.

8. The exercise apparatus according to claim 1, further including a rod provided to aid the balance of the user when using the exercise apparatus, the rod positioned behind the seat and mounted to a pair of spaced seat support members, the rod having a length greater than the width of the seat so as to be graspable by the user.

9. The exercise apparatus according to claim 1, wherein a seat back provided with the seat may be folded down, thereby reducing the overall height of the exercise apparatus when not in use to facilitate the storage thereof.

10. An exercise apparatus for providing a full body workout wherein a plurality of muscle groups of a user may be exercised in succession, the apparatus comprising:

(a) a rectangular horizontally extending frame assembly;

(b) elastic means that is stretchable when a sufficient force is applied through movements of the user, the elastic means having a first end and a second end, the first end adjustably fixed to the frame assembly;

(c) a pair of foot pedals slidably mounted on the frame assembly and movable between a first position and a second position, the foot pedals biased in the first position, which is proximate to the position of the user, by the elastic means, and movable to a second distal position when the user applies a suitable force to the foot pedal, the second end of each elastic means coupled to each foot pedal to establish the biasing of the foot pedals in the first position;

(d) a seat adjustably mounted to the frame assembly, the position of the seat being adjustable to enable the distance between the seat and foot pedals to be adjusted, as required, to accommodate a user;

(e) a plurality of elastic cables, each having a first end and a second end, the first end removably mounted to the frame assembly and the second end configured for grasping by the user; and (f) means for mounting the first end of each of the elastic cables to the frame assembly in one of a plurality of preconfigured positions.

* * * * *